US010584710B2

(12) United States Patent
Welschinger et al.

(10) Patent No.: US 10,584,710 B2
(45) Date of Patent: Mar. 10, 2020

(54) SEAL ARRANGEMENT FOR A HIGH-PRESSURE PUMP AND HIGH-PRESSURE PUMP HAVING SUCH A SEAL ARRANGEMENT

(71) Applicant: Sulzer Management AG, Winterthur (CH)

(72) Inventors: Thomas Welschinger, Radolfzell (DE); Marco Carvalho, Zürich (CH)

(73) Assignee: SULZER MANAGEMENT AG, Winterthur (CH)

( * ) Notice: Subject to any disclaimer, the term of this patent is extended or adjusted under 35 U.S.C. 154(b) by 391 days.

(21) Appl. No.: 15/300,433

(22) PCT Filed: Apr. 14, 2015

(86) PCT No.: PCT/EP2015/058067
§ 371 (c)(1),
(2) Date: Sep. 29, 2016

(87) PCT Pub. No.: WO2015/169548
PCT Pub. Date: Nov. 12, 2015

(65) Prior Publication Data

US 2017/0122331 A1 May 4, 2017

(30) Foreign Application Priority Data

May 5, 2014 (EP) ..... 14167034

(51) Int. Cl.
*F04D 29/08* (2006.01)

(52) U.S. Cl.
CPC ..... *F04D 29/086* (2013.01)

(58) Field of Classification Search
CPC ..... F04D 29/08; F04D 29/083; F04D 29/086; F04D 1/06; F04D 17/12; F04D 19/02; F04D 5/006
See application file for complete search history.

(56) References Cited

U.S. PATENT DOCUMENTS 4,239,124 A 12/1980 Inouye
5,236,202 A * 8/1993 Krouth ..... F16J 15/121 277/644
5,846,052 A * 12/1998 Kameda ..... F04D 1/06 415/182.1

(Continued)

FOREIGN PATENT DOCUMENTS

CN 1071495 A 4/1993
CN 1619195 A 5/2005

(Continued)

OTHER PUBLICATIONS

DE 102004044775, Specification in English, Espacenet (Year: 2006).*

(Continued)

*Primary Examiner* — Kenneth Bomberg
*Assistant Examiner* — John S Hunter, Jr.
(74) *Attorney, Agent, or Firm* — Global IP Counselors, LLP

(57) ABSTRACT

A sealing arrangement for sealing a pressure chamber in a high pressure pump which is bound by a first and a second bounding element, includes a separate sealing element which has a first sealing surface for co-operating with the first bounding element, as well as having a second sealing surface for cooperating with the second bounding element. The two sealing surfaces are inclined with respect to one another and each have a groove for receiving a sealing ring. The sealing element is arranged in such a way that it can be displaced totally along one of the bounding elements on the application of pressure.

18 Claims, 6 Drawing Sheets

(56) References Cited

U.S. PATENT DOCUMENTS

| | | | | |
|---|---|---|---|---|
| 7,086,832 | B2 * | 8/2006 | Lienau | F04D 1/063 415/214.1 |
| 7,296,800 | B2 * | 11/2007 | Tsuboi | F16J 15/344 277/358 |
| 8,814,175 | B2 * | 8/2014 | Tohdoh | F16J 15/0887 277/644 |
| 8,820,220 | B2 * | 9/2014 | Thelen | A47J 27/09 99/337 |
| 9,068,656 | B2 * | 6/2015 | Franz | F16J 15/3216 |
| 9,702,371 | B2 * | 7/2017 | Meuter | F04D 1/063 |
| 2015/0159669 | A1 * | 6/2015 | Meuter | F04D 1/063 415/170.1 |

FOREIGN PATENT DOCUMENTS

| | | | | |
|---|---|---|---|---|
| CN | 101754703 | A | 6/2010 | |
| CN | 102434689 | A | 5/2012 | |
| CN | 102483163 | A1 | 5/2012 | |
| CN | 103225692 | A | 7/2013 | |
| DE | 69621545 | T2 | 1/2003 | |
| DE | 102004044775 | A1 * | 4/2006 | F04B 37/12 |
| DE | 102011084831 | A1 * | 4/2013 | F04D 29/40 |
| EP | 0766007 | A1 | 4/1997 | |
| EP | 0916850 | A1 | 5/1999 | |
| JP | 57173595 | A | 10/1982 | |
| RU | 2232921 | C2 | 7/2004 | |
| WO | 2013120549 | A1 | 8/2013 | |

OTHER PUBLICATIONS

International Search Report and Written Opinion dated Jul. 30, 2015 in International Application No. PCT/EP2015/058067, filed Apr. 14, 2015 (with partial English Translation).

* cited by examiner

SEAL ARRANGEMENT FOR A HIGH-PRESSURE PUMP AND HIGH-PRESSURE PUMP HAVING SUCH A SEAL ARRANGEMENT

CROSS-REFERENCE TO RELATED APPLICATIONS

This application is a U.S. National Stage application of International Application No. PCT/EP2015/058067, filed Apr. 14, 2015, which claims priority to EP Application No. 14167034.9, filed May 5, 2014, the contents of each of which is hereby incorporated herein by reference.

BACKGROUND

Field of Invention

The invention relates to a sealing arrangement for sealing a pressure chamber in a high pressure pump, as well as to a high pressure pump having such a sealing arrangement.

Background Information

The pressure chamber in a pump, in which a pressurized fluid to be conveyed by the pump is present, has to be sealed off with respect to its environment. In this connection the environment of the pressure chamber can be the environment of the pump typically present at atmospheric pressure, or—in the case of a multi-stage pump—a different pressure chamber of the pump in which the fluid to be conveyed is present at a higher or lower pressure.

The larger the pressure generated by the pump is the more difficult it is to provide efficient and reliable sealing arrangements. Having regard to high pressures of, for example, up to 1000 bar conveying pressure, pressure related elongations or deformations of the pump housing or of other components are frequently brought about. These can have the consequence that gaps open between components which bound the same pressure chamber, for example between the pump housing and the pump cover. Such gaps, which amongst other things can also arise due to different thermal expansions of the components, must then be reliably sealed in order to avoid a leakage of the fluid through the gaps.

The pressure induced opening of such gaps can, for example, be avoided or at least be limited to an uncritical degree, in that the components, between which the gap arises, are configured so stiff—and this generally means so thick-walled—that also for very high pressures only such small gaps arise such that the functionality of the sealing arrangement is not endangered. However, this has the disadvantage that significantly more material is required with regard to the thick-walled design and that the pump has a considerable increased weight. Both are rather disadvantageous effects from an economic point of view.

For this reason one strives to create sealing arrangements which also reliably and efficiently seal at very high pressures. Having regard to many sealing arrangements an O-ring is provided which is typically inserted into a groove of a sealing surface. In the International (PCT) patent application PCT/EP2012/071654, for example, a sealing arrangement is suggested having regard to which a groove-like recess is disposed in one of the components between which the seal should take place, the groove-like recess being configured in such a way that on an application of pressure of the groove a force is exerted in the direction onto the sealing surface of this component, which presses this sealing surface against the sealing surface of the component adjacent thereto. In this connection the application of pressure of the groove can bring about an elastic deformation or plastic deformation of its walls in order to thus avoid or to reduce the pressure induced opening of gaps between the components. An O-ring is provided in one of the two sealing surfaces contacting one another, the O-ring consisting of an elastomer and being arranged in a groove disposed in this sealing surface. This O-ring serves for a reliable seal between the two sealing surfaces contacting one another.

Specifically for sealing arrangements with O-rings the danger exists with regard to the extrusion of the O-ring. In this connection it is meant that the O-ring is deformed on the application of pressure in such a way that a part of it is pressed into a gap opening under pressure which can have the consequence of a damaging of the O-ring and in this way a loss of the sealing effect.

SUMMARY

Starting from this state of the art it is thus an object of the invention to suggest a sealing arrangement for sealing a pressure chamber in a high pressure pump which still reliably works also for very high pressures and in which in particular an extrusion of a sealing ring, more specifically of an O-ring, into a gap opening under pressure is prevented. Furthermore, it is an object of the invention to suggest a high pressure pump having such a sealing arrangement.

The subject matter of the invention satisfying this object is characterized by the features of described herein.

In accordance with the invention a sealing arrangement is thus suggested for sealing a pressure chamber in a high pressure pump, the pressure chamber being bounded by a first and a second bounding element, having a separate sealing element which has a first sealing surface for cooperating with the first bounding element, as well as having a second sealing surface for cooperating with the second bounding element; wherein the two sealing surfaces are inclined with respect to one another and each have a groove for the reception of a sealing ring; and wherein the sealing element is arranged and configured in such a way that it can be displaced totally along one of the bounding elements on the application of pressure.

Having regard to this sealing arrangement the total sealing element can consequently be displaced on the application of pressure along one of the bounding elements. Hereby the effect is achieved that a gap opening on the application of pressure between the two bounding elements is reliably covered by the sealing element through the displacement of the sealing element such that an extrusion of a sealing ring into the opening gap is avoided. This ensures an efficient sealing effect also with regard to very high pressures of, for example, up to 1000 bar.

The provision of a separate sealing element having the grooves for the reception of sealing rings moreover has the advantage that a different material can be selected for this sealing element than, for example, the material from which the bounding elements are made. For this reason, a material can be selected for the sealing element whose mechanical properties, such as e.g. the elastic properties, are as ideal as possible on the application of pressure.

Preferably, the two sealing surfaces of the sealing element include an angle of substantially 90°. This measure is in particular advantageous with regard to the capability of being displaced of the sealing element on the application of pressure.

An advantageous measure is the provision of a support ring for positioning the sealing element, in particular in the pressure-less state. It can thereby be realized that the sealing element has a defined starting position and/or starting orientation such that on the application of pressure it reacts in the desired manner.

In a preferred embodiment the support ring contacts a support surface of the sealing element in the pressure-less state, wherein the support surface is different from the two sealing surfaces of the sealing element. Hereby it is ensured that the sealing element can be displaced on the application of pressure without the hindrance by the support ring.

In accordance with a particularly preferred embodiment which has proven itself in practice, the sealing element has a substantially L-shaped cross-section having a long shank which forms the first sealing surface and having a short shank which forms the second sealing surface.

Preferably the sealing element is arranged in a displaceable manner along the second bounding element. This is in particular preferred having regard to the design having the substantially L-shaped cross-section. The surface of the sealing element formed by the long shank at which a pressure is applied is larger than the surface formed by the short shank at which a pressure is applied. A larger force thus results through the pressure that is applied on the first said surface formed by the long shank, such that the sealing element is reliably displaced by this larger force along the second bounding element which cooperates with the sealing surface formed by the shorter shank.

It is particularly preferred when the sealing element is arranged in a displaceable manner along the first and the second bounding elements, as thereby the sealing element can follow pressure induced displacements or bulges both of the first and also of the second bounding elements. Hereby a reliable seal can be realized in a high pressure pump both in the radial direction as well as in the axial direction.

A further advantageous measure includes therein that the first sealing surface is configured conically between the groove disposed therein and its end facing the second sealing surface. In this connection it is meant that the first sealing surface is configured inclined between the two sealing surfaces starting from the groove disposed therein in the direction of the contact line. This has the consequence that the first sealing surface moves away even further from the groove in the direction of the contact line from the first bounding element. Through this measure it is ensured that that edge which bounds the groove in the first sealing surface and lies closer to the contact line comes into contact with the first bounding elements first on the application of pressure and that the highest surface pressure is present at this edge respectively in the region of this edge. This measure represents an additional security such that a sealing ring inserted into the groove, e.g. an O-ring, does not experience an extrusion on the application of pressure.

For the same reason it is advantageous when the second sealing surface is of conical design between the groove disposed therein and its end facing the first sealing surface.

In this connection it has been proven in practice when the angle of the cone respectively amounts to at most 2°, preferably to at most 1°.

In accordance with a preferred embodiment the sealing arrangement is configured as a radial seal arrangement.

Furthermore, a high pressure pump is suggested by the invention comprising a sealing arrangement in accordance with the invention. By this sealing arrangement the high pressure pump can also be operated safely and securely at very high pressures, for example, of up to 1000 bar.

Having regard to a preferred embodiment the high pressure pump includes a pump cover and a pump housing, wherein the sealing arrangement seals between the pump cover and the pump housing.

In accordance with a preferred application the high pressure pump is configured as a multi-stage pump.

In a preferred embodiment of the high pressure pump the sealing arrangement is provided for sealing between a pressure chamber and an intermediate pressure chamber.

A further preferred design of the high pressure pump is when the sealing arrangement is provided for sealing between a separation element and the pump housing or between the pump cover and the pump housing.

Further advantageous measures and designs of the embodiment result from the features described herein.

BRIEF DESCRIPTION OF THE DRAWINGS

Referring now to the attached drawings which form a part of this original disclosure.

DETAILED DESCRIPTION OF THE EMBODIMENTS

Figure 1:
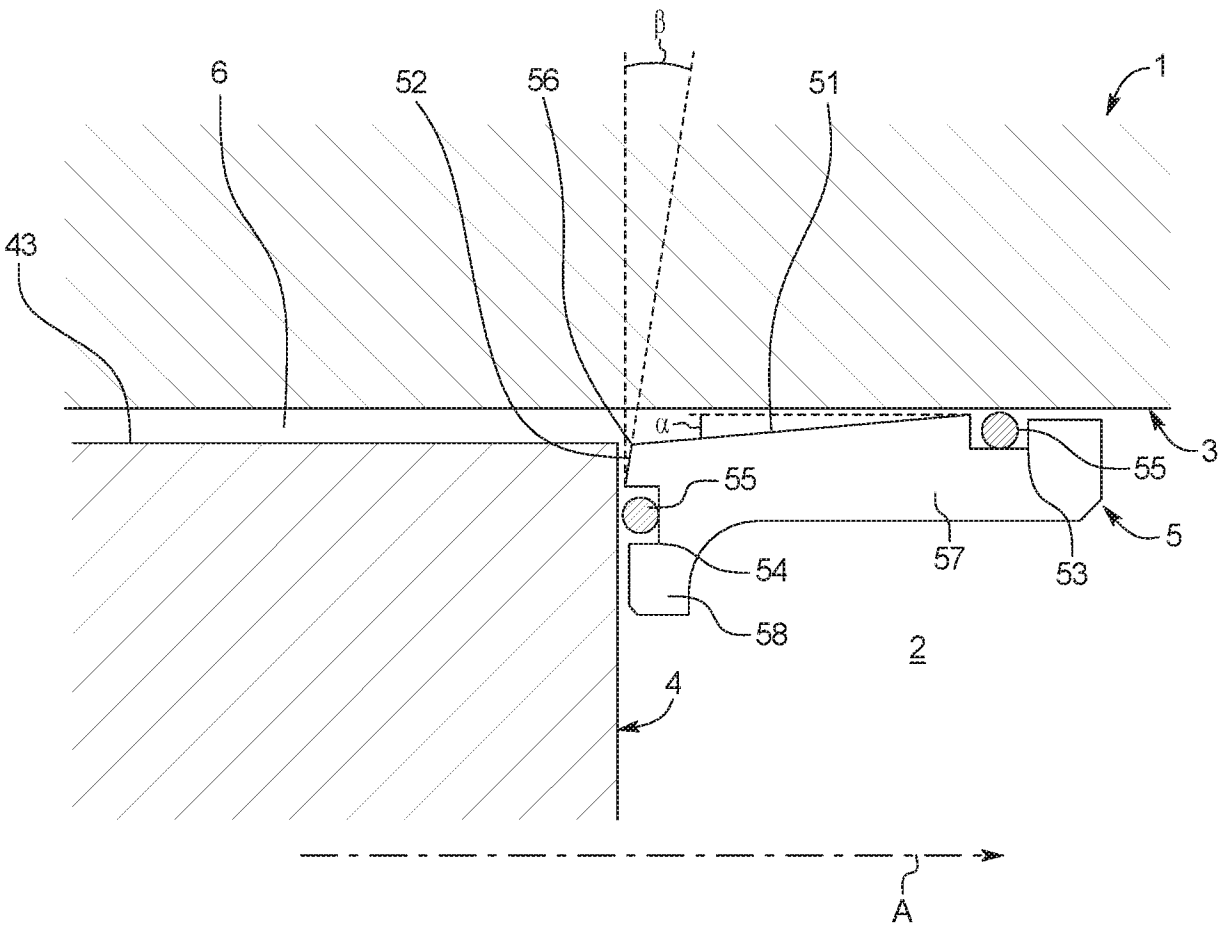
FIG. 1 is a sectional illustration of an embodiment of a sealing arrangement in accordance with the invention.
Figure 6:
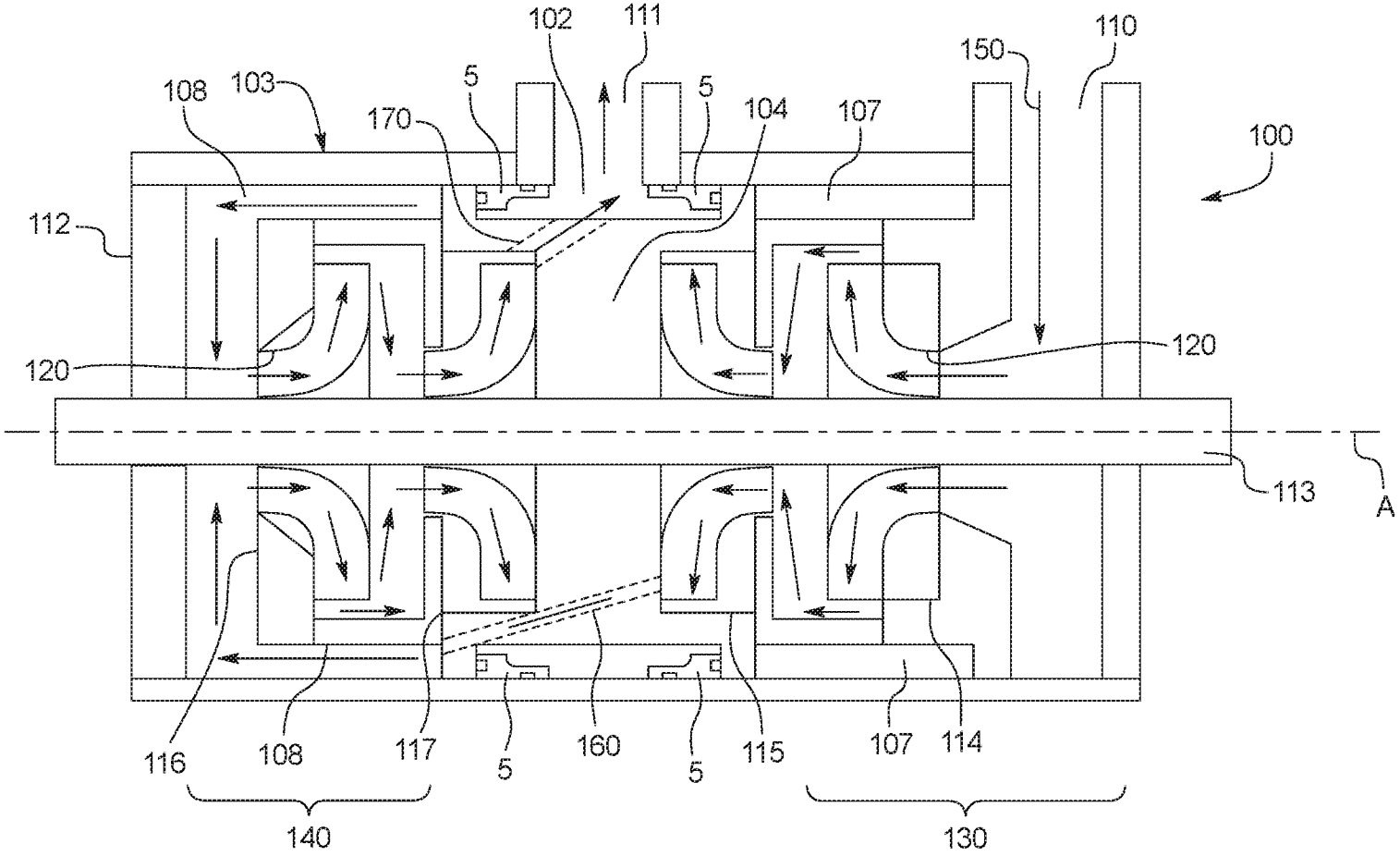
FIG. 6 is a schematic illustration of an embodiment of a high pressure pump in accordance with the invention.

In a schematic sectional illustration FIG. 1 shows an embodiment of a sealing arrangement in accordance with the invention which is totally referred to with the reference numeral 1 and serves for the sealing of a pressure chamber 2 in a high pressure pump 100 (see FIG. 6). The pressure chamber 2 is bound by a first sealing element 3 and by a second sealing element 4. The sealing arrangement 1 further comprises a separate sealing element 5 which has a first sealing surface 51 for cooperating with the first bounding element 3, as well as a second sealing surface 52 for cooperating with the second bounding element 4. The term "separate sealing element" in this connection means that the sealing element 5 is not an integral component, for example, of one of the bounding elements 3, 4, but is configured as its own component.

As can be clearly be recognized, the illustration of FIG. 1 only shows a part of the sealing arrangement 1, namely, for example, the upper half. In a high pressure pump 100 the sealing element 5 is generally configured rotationally symmetric with respect to the pump shaft which is indicated in FIG. 1 by an axis of rotation A about which the rotating parts of the pump rotate in the operating state. This means that the sealing element 5 is typically of ring-like design. Thus only one cross-section through the ring-shaped sealing element 5 is illustrated in FIG. 1. Also the pressure chamber 2 is typically configured as a ring space which surrounds the pump shaft.

A respective groove is disposed in each of the two sealing surfaces 51, 52 of the sealing element 5, namely a first groove 53 and a second groove 54 which each serve for the reception of a sealing ring 55 which is, for example, configured as an O-ring. The sealing rings 55 in a manner known per se serve for the seal between the respective sealing surface 51 or 52 and the bounding elements 3 or 4 cooperating therewith and are, for example, manufactured from an elastomer material.

It is understood that the sealing rings can also be other sealing means or devices known per se, for example, metal rings or ring discs or sealing means of a plastic, such as of PTFE or of PEEK.

As is shown in FIG. 1 the two sealing surfaces 51, 52 of the sealing element 5 are inclined with respect to one another and contact one another along a contact line 56. More specifically, the two sealing surfaces 51, 52 of this embodiment include an angle of substantially 90°. The sealing element 5 in accordance with FIG. 1 has a substantially L-shaped cross-section having a long shank 57 which forms the first sealing surface 51 and with which the first bounding 3 cooperates and has a short shank 58 which forms the second sealing surface 52 and with which the second bounding element 4 cooperates.

In accordance with the invention the sealing element 5 is arranged and configured in such a way that it can be displaced totally along at least one of the bounding elements 3, 4 on an application of pressure. This will be explained in the following with reference to FIG. 1.

In the pressure-less state, this means when no overpressure is present in the pressure chamber 2 relative to its environment, the first bounding element 3 contacts the boundary surface 43 of the second bounding element 4. This can be realized in a pump, for example, thereby that the component which forms the first bounding element 3 is fixedly screwed to that component which forms the second bounding element 4. When an ever increasing pressure is now generated in the pressure chamber 2, then it can happen that a gap 6 opens between the bounding elements 3, 4 by pressure induced deformations, for example bulges, of the first or of the second bounding elements 3, 4. This state is illustrated in FIG. 1. As the pressure in the pressure chamber 2 is also applied at the sealing element 5 and this is totally displaceable along the second bounding element 4, the complete sealing element 5 is moved upwardly in accordance with the illustration and thereby closes the gap 6 with respect to the pressure chamber 2 such that no fluid can escape from the pressure chamber 2 through the gap 6, but rather the sealing effect is maintained also with regard to very high pressures.

Figure 2:
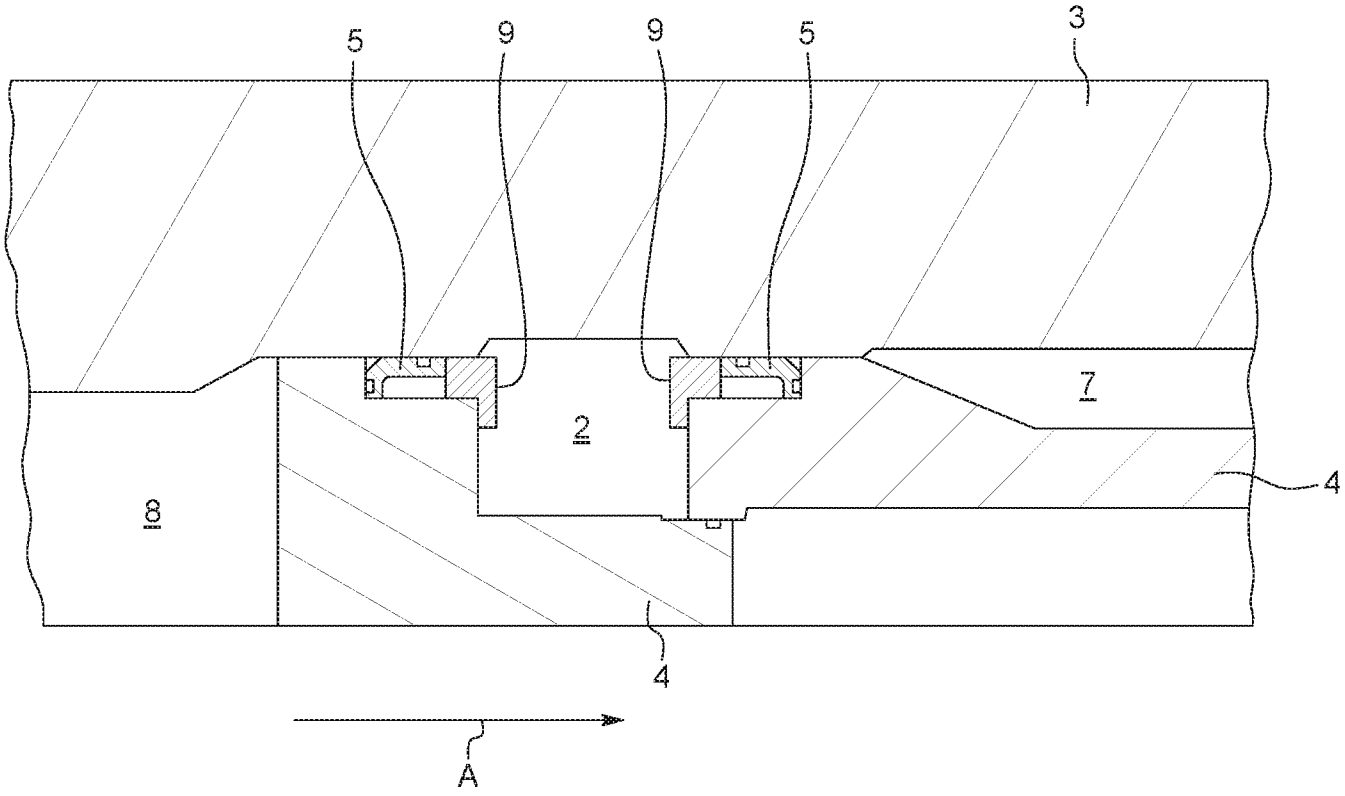
FIG. 2 is a schematic illustration of a first variant for the arrangement of the sealing element.

If the second bounding element 4 is displaced under the influence of the pressure in the pressure chamber 2 relative to the first bounding element 3 along the boundary surface 43, for example, to the left in accordance with the illustration of FIG. 2, then the sealing element 5 can also follow this movement, namely in that the sealing element 5 is totally displaced along the first bounding element 3. Having regard to this displacement the substantially ring-shaped sealing element 5 expands.

With respect to the axis of rotation A, the sealing element 5 can thus be displaced totally both in the radial direction—this means upwardly in accordance with the illustration of FIG. 1 (or downwardly)—as well as in the axial direction—this means to the right (or to the left) in accordance with the illustration of FIG. 1. The displacement in the axial direction then naturally is associated with an expansion of the substantially ring-shaped sealing element 5.

Through this capability of being displaced both in an axial as well as in a radial direction gaps 6 between the bounding elements 3, 4 are not only closed, but it is rather advantageously further avoided that a gap opens or is formed between the first sealing surface 51 and the first bounding element 3 or between the second sealing surface 52 and the second bounding element 4 on an application of pressure.

Through this capability of being displaced of the sealing element 5 it is thus ensured that a reliable seal of the pressure chamber 2 is realized also for very high pressures in the pressure chamber 2 of, for example, up to 1000 bar.

It in particular ensures the radial capability of being displaced of the sealing element 5 such that the gap 6 opening on the application of pressure between these two bounding elements 3 and 4 is reliably closed by the sealing element 5. Through the closing of the gap 6 by the sealing element 5 an extrusion of the sealing rings 55, in particular of the O-rings 55, into the gap 6 is efficiently prevented.

Having regard to an application of pressure of the sealing element 5 its capability of being displaced is generally combined with a deformation of the sealing element 5, this means besides the displacement of the sealing element 5 or during the displacement of the sealing element the sealing element can also be deformed. This deformation is preferably an elastic deformation, this means a deformation which is completely reversible on the removal of pressure. As the sealing element 5 is configured as a separate component, this means that it, for example, is not an integral component of one of the bounding elements 3, 4, one has the largest possible degree of freedom with respect to the material selection for the sealing element 5. Thus a material can be selected for the sealing element 5 that is ideal for the respective case of application with regard to its elastic properties. Titanium has been found to be a particularly preferred material for the sealing element 5.

In order to realize an even higher level of protection of the sealing rings 55 respectively of the O-rings 55 against extrusion the measures described in the following are advantageous.

The first sealing surface 51 is of conical design between the first groove 53 and the contact line 56 at which the two sealing surfaces 51, 52 contact one another and indeed is configured such that in the pressure-less state the spacing between the first sealing surface 51 and the first bounding element 3 is minimal with respect to that bounding edge of the first groove 53 which is closer to the contact line 56 (in FIG. 1 the left bounding edge in accordance with the illustration) and then increases in the direction of the contact line 56. This inclination of the first sealing surface 51 is illustrated in FIG. 1 and the associated angle of the cone is referred to with a. Through this measure it is ensured that, on the application of pressure at the sealing element 5, this left bounding edge of the first groove 53 respectively of the region at the bounding edge of the long shank 57 in accordance with the illustration comes into contact first with the first bounding element 3 and that the highest contact pressure also exists there (with respect to the first sealing surface 51). It can thereby be avoided in an improved manner that an extrusion of the sealing ring 55 from the first groove 53 is brought about between the first sealing surface 51 and the first bounding element 3.

Advantageously also the second sealing surface 52 is of conical design between the second groove 54 and the contact line 56 at which the two sealing surfaces 51, 52 contact one another and indeed such that in the pressure-less state the spacing between the second sealing surface 52 and the second bounding element 4 is minimal at that bounding edge of the second groove 54 which is closer to the contact line 56 (the upper bounding edge in accordance with the illustration of FIG. 1) and then increases in the direction of the contact line 56. This inclination of the second sealing surface 52 is illustrated in FIG. 1 and the associated angle of the cone is referred to with (3. Through this measure it is ensured that, on an application of pressure at the sealing element 5, this first upper boundary edge of the second groove 54 respectively of the region at this bounding edge of the short shank 58 in accordance with the illustration comes into contact with the second bounding element 4 and that also there the highest contact pressure exists (with respect to the second sealing surface 52). It can thereby be even more reliably avoided that an extrusion of the sealing ring 55 from the second groove 54 is brought about between the second sealing surface 52 and the second bounding element 4.

A further optional advantageous measure is brought about when the long shank 57 or the short shank 58 or preferably both shanks 57, 58 are respectively cylindrically configured and cut back in the region between the first or the second grooves 53, 54 and the end disposed remote from the contact line 56 (this means are not conically and are not inclined). In FIG. 1 this can be recognized in that these regions respectively run in parallel to the first and to the second bounding element 3, 4 and have a larger spacing from the first and the second bounding element 3, 4 respectively than the respective bounding edge of the first and the second groove 53, 54 which lies closer to the contact line 56. Also through this measure the effect is supported that the respectively larger contact pressure of the first and the second sealing surfaces 51, 52 is present in the region of that bounding edge of the first and the second grooves 53, 54 which lies closer to the contact line 56.

The two angles $\alpha$ and $\beta$ of the respective cone of the first and of the second sealing surfaces 51, 52 can be like or different. In practice it has been proven when $\alpha$ and $\beta$ respectively amount to at most 2° and preferably to at most 1°. In particular values for $\alpha$ and $\beta$ of between 1.0° and 1.2° have proven to be successful.

It is understood that not only a pressure induced gap, but also thermally induced gaps, such as, for example, those that can be caused by different thermal coefficients of expansion of components bounding one another can be closed in an analogous manner by the sealing arrangement by the displacement of the sealing element 5.

Besides the L-shaped cross-section of the sealing element 5 described in this context naturally also other geometries are possible as a cross-section of the sealing element, for example the two shanks 57 and 58 can also have an equal length such that the cross-sectional surface is like that of an angular section having the shape of an isosceles alternatively rounding offs can be provided.

Having regard to the subsequent description of different variants for the arrangement of the sealing element 5 as well as of an embodiment of a high pressure pump in accordance with the invention, parts having a like function or equivalent function are referred to with the same reference numerals like in FIG. 1 and in this connection have the same meaning as that described in association with FIG. 1. For reasons of better clarity the illustration of different particulars has been omitted from the FIGS. 2-6. Thus, for example, the sealing rings 55 which are disposed in the grooves 53 and 54, and which are preferably configured as an O-ring, are not illustrated. Also the described conical design of the sealing surfaces 51, 52 described in connection with FIG. 1 is not illustrated in the FIGS. 2 to 6. However, it is understood that all measures which are described in connection with FIG. 1, such as for example, the cut back and the cylindrical design of the sealing surfaces 51, 52 in the region between the first and the second grooves 53, 54 respectively and its end disposed remote from the contact line 56 can thus also be realized in an analogous manner with regard to the embodiments illustrated in the FIGS. 2-6 respectively on their own or in an arbitrary combination with one another. Vice versa the explanations made in connection with the FIGS. 2-6 are also true in an analogous manner having regard to the embodiment in accordance with FIG. 1 and with regard to the respective other embodiments of the FIGS. 2-6.

In FIG. 2 a first variant is illustrated for the arrangement of the sealing element 5. More specifically, this is an arrangement for the radial seal such as it can be used in a multistage pump. Having regard to multi-stage pumps, in particular having regard to such pumps having a so-called back-to-back arrangement (see also FIG. 6) at least one intermediate pressure exists between the pressure at the inlet of the pump, for example, atmospheric pressure, and the highest pressure in the pressure chamber which is typically connected to the outlet of the pump. The intermediate pressure typically being present with regard to a back-to-back arrangement in the middle between the pressure at the inlet and the highest pressure in the pressure chamber 2, thus, for example, the pressure at the inlet can be atmospheric pressure, the pressure in the pressure chamber 2 can amount to, for example 1000 bar, and the intermediate pressure can lie at 500 bar. Two intermediate pressure chambers 7 and 8 are provided besides the pressure chamber 2 in FIG. 2, the pressure of the fluid to be conveyed respectively being approximately half as large in the intermediate pressure chambers 7 and 8, as compared to the pressure chamber 2. Having regard to the variant shown in FIG. 2 the first bounding element 3 is configured as a pump housing 3 and the second housing element 4 serves the separation between the two intermediate pressure chambers 7, 8, as well as the respective separation of each of the intermediate pressure chambers 7, 8 from the pressure chamber 2. Two sealing elements 5 are provided which are each a part of a radial seal arrangement and of which the one sealing element 5 serves the seal between the pressure chamber 2 and the intermediate pressure chamber 7 and the other sealing element serves the seal between the pressure chamber 2 and the intermediate pressure chamber 8. In addition to the components described in FIG. 1, a support ring 9 is respectively also provided for these sealing arrangements, the function of the support ring being the positioning of the respective sealing element 5 in the pressure-less state. The support ring 9 can, for example, be configured as a split ring, this means it can be composed of two or more segments which are for example, inserted into the pressure chamber 2 and are screwed to its wall. In this connection the support ring 9 is screwed and/or attached with regard to the sealing element 5 with clearance, as the support ring 9 should only position the sealing element 5, but not clamp it or prevent or influence the capability of being displaced of the sealing element 5 in an undesired manner. No sealing function is associated with the support ring 9 it should only ensure that the sealing element 5 is present in a defined position in the pressure-less state.

Having regard to the design shown in this example, the support ring 9 respectively has a substantially L-shaped cross-section. With one of the shanks of the L the support ring supporting itself at the inner wall of the pressure chamber 2, the other shank forming the surface which supports the sealing element 5 in the pressure-less state. The support surface of the sealing element 5, which contacts the support ring in the pressure-less state, in this example respectively is the end face of the long shank 57 of the sealing element 5.

If the pressure chamber 2 is now pressurized, then a bulging or other extent of the pump housing 3 can be brought about, whereby a gap can open between the pump housing 3 and the second bounding element 4. This is effectively closed—as is explained in connection with FIG. 1 through the displacement of the sealing elements 5.

It is understood that also with regard to the embodiments shown in FIG. 1, as well as with regard to the embodiments in accordance with FIGS. 3-6 a support ring 9 can be provided in an analogous manner.

Figure 3:
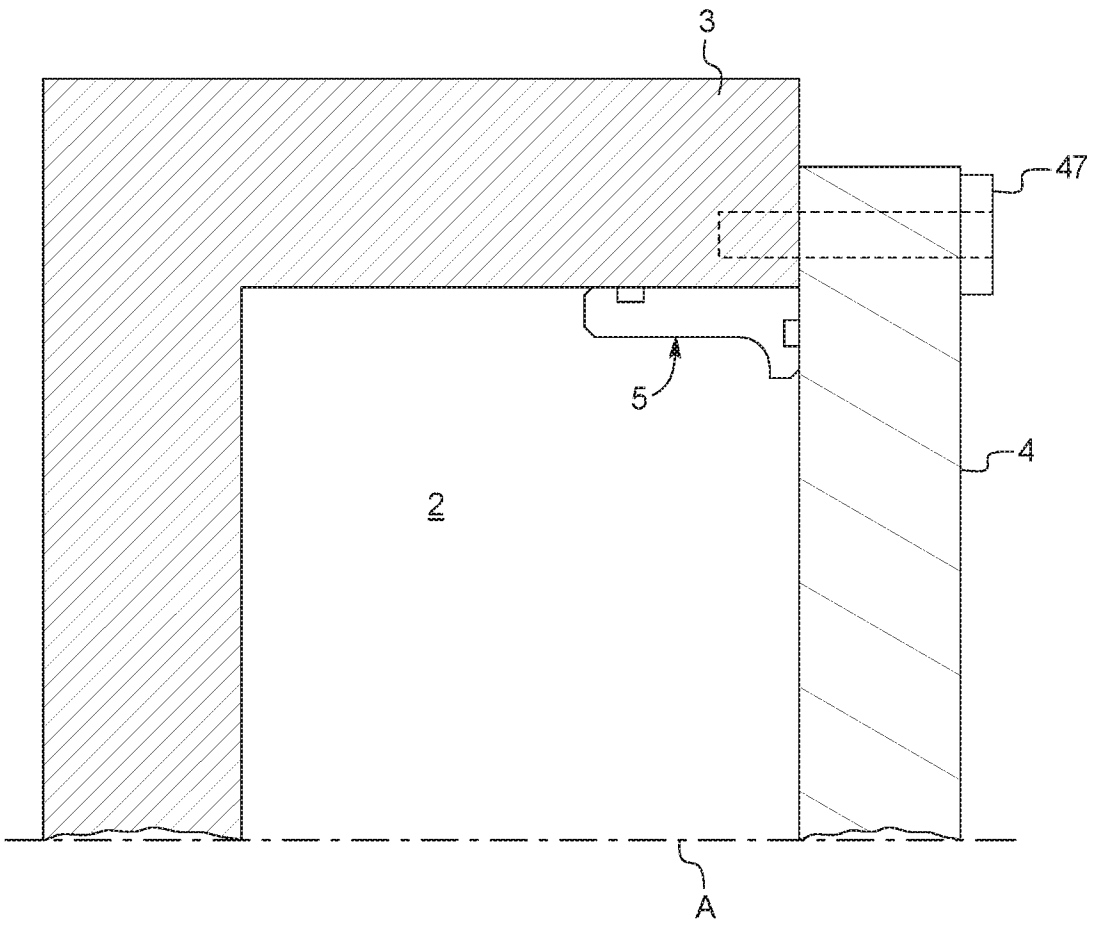
FIG. 3 is a schematic illustration of a second variant for the arrangement of the sealing element.

A second variant for the arrangement of the sealing element 5 is illustrated in FIG. 3. Having regard to this variant the sealing element 5 serves for the seal between the pump housing which represents the first bounding element 3 in this example and a pump cover which in this example represents the second bounding element 4. Typically, the pump cover 4 is fixedly screwed to the pump housing 3 by a plurality of screws 41 of which only one is illustrated in FIG. 3. Typically atmospheric pressure is present outside of the pump housing 3, whereas an increased pressure exists in the pressure chamber 2. Having regard to very high pressures in the pressure chamber 2 the pump cover 4 bulges, whereby a gap opens between the pump housing 3 and the pump cover 4. As the sealing element 5 can move in the axial direction—this means in the direction of the axis of rotation A—the sealing element is displaced to the right on the application of pressure in accordance with the illustration and thus reliably closes the gap between the pump cover 4 and the pump housing 3. The pump housing 3 can also additionally expand, this means it can virtually be inflated. Also this movement can be followed by the sealing element 5 as it can be displaced also with regard to the radial direction. This displacement with regard to the radial direction is generally associated with an expansion of the sealing element 5, as on an expansion of the pump housing 3, its internal diameter is also enlarged in the radial direction.

The term according to which the sealing element is "displaceably arranged" should thus be understood in the framework of this invention such that an inflation and/or an extension of an annular sealing element is meant and/or comprised.

Figure 4:
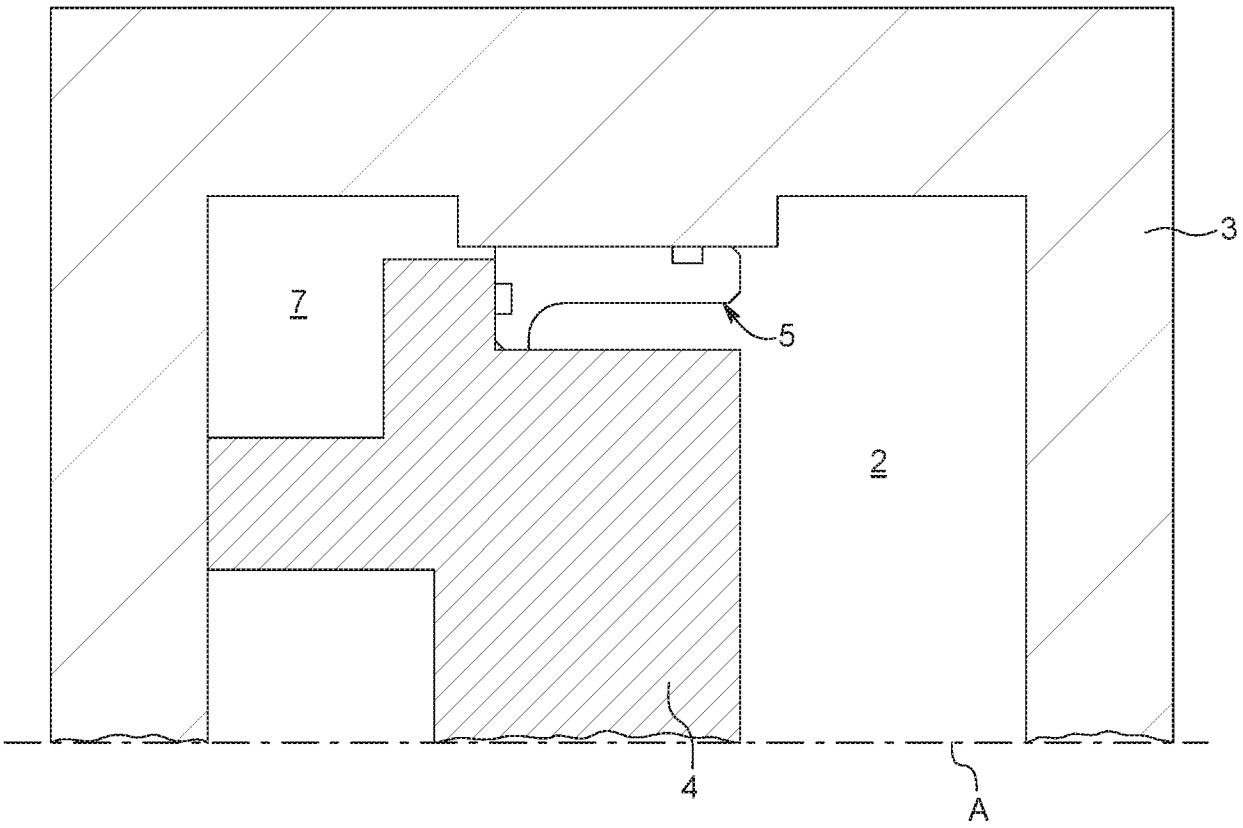
FIG. 4 is a schematic illustration of a third variant for the arrangement of sealing elements.

Having regard to the third variant illustrated in FIG. 4, the sealing element 5 also serves the purpose of sealing the pressure chamber 2 of a pump with regard to an intermediate pressure chamber 7. The maximum pressure of, for example, 1000 bar is present in the pressure chamber 2 and an arbitrary intermediate pressure exists in the intermediate pressure chamber 7, the intermediate pressure lying between the atmospheric pressure, respectively the ambient pressure, and the pressure in the pressure chamber 2, for example, the intermediate pressure is half as large as the pressure in the pressure chamber 2. Having regard to this variant the pump housing forms the first bounding element 3. The second bounding element 4 is a component, for example a separation element 4, which bounds the intermediate pressure chamber 7 from the pressure chamber 2.

Figure 5:
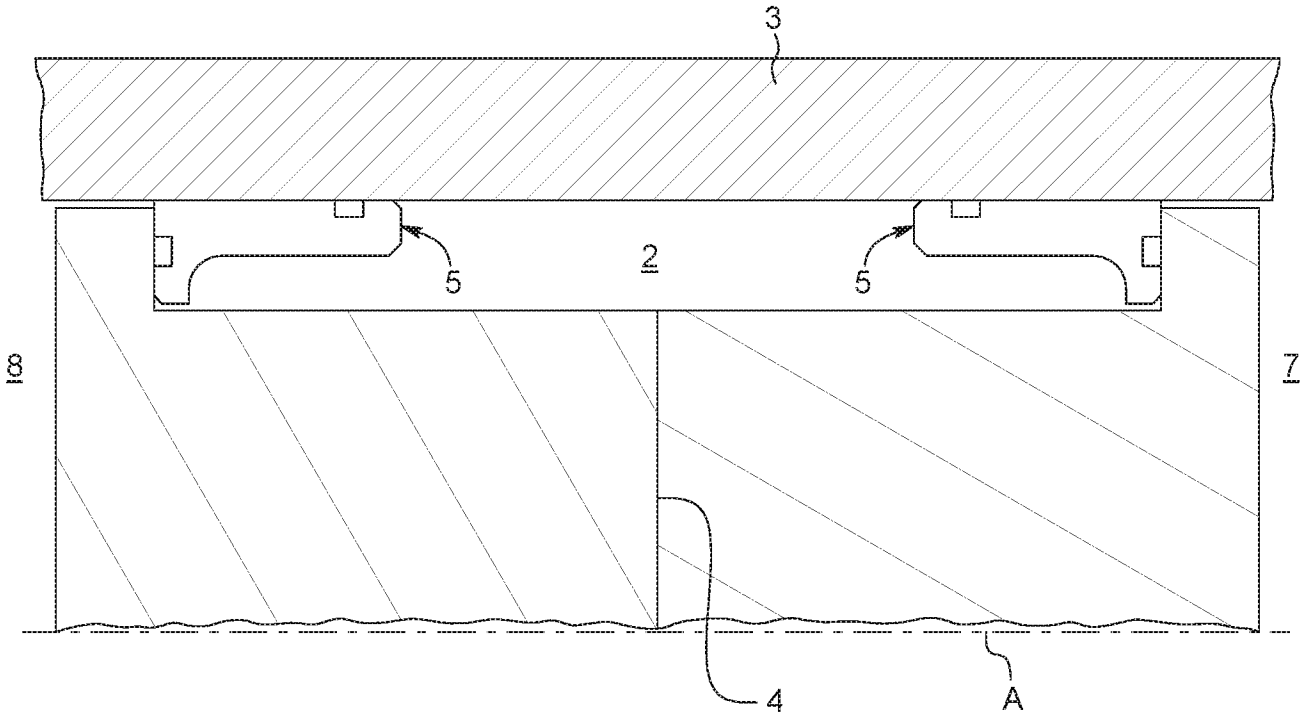
FIG. 5 is a schematic illustration of a fourth variant for the arrangement of sealing elements.

The fourth variant illustrated in FIG. 5 for the arrangement of sealing elements 5 is illustrated similar to that shown in FIG. 2. This arrangement is specifically suitable for multistage pumps in back-to-back arrangements. Having regard to these pumps substantially two identical blocks exist of which each can include a plurality of pump stages. These two blocks are arranged with respect to one another in mirror symmetry, —this means back to back— such that the pressure chamber 2, in which the highest pressure exists and which is connected to the outlet of the pump, is typically arranged as an annular space in the center of the pump. Having regard to this variant two sealing elements 5 are provided. The first bounding element 3 is formed by the pump housing 3, whereas the second bounding element 4 is arranged as a separation element which is the separating wall between the blocks arranged back to back. The intermediate pressure chamber 7 is associated with one of the blocks, and the intermediate pressure chamber 8 is associated with the other block. Atmospheric pressure or ambient pressure exists outside of the pump housing 3 and substantially the same pressure exists in the two intermediate pressure chambers 7 and/or 8, the intermediate pressure respectively typically being half as large as the pressure in the pressure chamber 2.

An embodiment of a high pressure pump in accordance with the invention is schematically illustrated and in section in FIG. 6, the high pressure pump being referred to totally with the reference numeral 100. The high pressure pump 100 is a multi-stage high pressure pump—in this example a four-stage high pressure pump—having a back to back arrangement which is configured as a radial centrifugal pump. The high pressure pump 100 has a pump housing 103, a pump cover 112 for closing the pump housing 103, an inlet 110 through which the fluid to be conveyed, for example, a liquid, such as, water or crude oil, can arrive in the high pressure pump 100 and an outlet 111 via which the then pressurized fluid exits the high pressure pump 100. For driving the high pressure pump 100 a pump shaft 113 is provided which rotates about the axis of rotation A in the operating state and which is driven by a non-illustrated drive unit.

The high pressure pump 100 has four stages substantially of like design, namely a first stage 114, a second stage 115, a third stage 116 and a fourth stage 117. Each of these stages 114-117 respectively has an impeller 120. Each impeller 120 is rotationally fixedly connected to the pump shaft 113. The first and the second stages 114, 115 belong to a first block 130. The third and the fourth stage 116, 117 belong to a second block 140. The two blocks 130, 140 are separated from one another by a separation element 104 which is fixed with regard to the pump housing 103. The two blocks 130, 140 of substantially like design are arranged in mirror symmetry with regard to the separation element 104, this means these are arranged back to back, which is why this assembly is also referred to as a back to back arrangement.

The extent of flow of the fluid through the high pressure pump 100 is illustrated in FIG. 6 by arrows, of which only the first is referred to at the inlet 110 using the reference numeral 150. The fluid flows from the inlet 110 in the axial direction to the impeller 120 of the first stage 114 and is guided from its outlet in the axial direction to the impeller of the second stage 115. From the outlet of the second stage 115 which simultaneously also forms the outlet of the first block 130 the fluid is guided through a flow connection 160 which is disposed in the separation element 104 into an intermediate pressure chamber 108 of the second block 140 through which the fluid arrives at the inlet to the third stage 116. From the outlet of the third stage 116 the fluid is guided in the axial direction to the inlet of the fourth stage 117 which finally advances the fluid to the high pressure with which it is made available at the outlet 111 of the high pressure pump 100. From the outlet of the fourth stage 117 a high pressure flow connection 170 leads to the pressure chamber 102 which is connected to the outlet 111 of the high pressure pump 100. The pressure chamber 102 is substantially configured as a ring space which radially leads outwardly around the separation element 104.

Also disposed in the first block 130 is an intermediate pressure chamber 107 which is substantially configured as a ring space and is arranged lying inwardly at the pump housing 103. This intermediate pressure chamber 107 is connected to the outlet of the second stage 115 via a flow connection not illustrated in FIG. 6 such that the same pressure exists in the two intermediate pressure chambers 107 and 108, the pressure corresponding to approximately half the pressure of the pressure in the pressure chamber 102 due to the substantially like design of the four stages 114-117.

As is emphasized by the arrows in FIG. 6 the fluid flows through the second block 140 in a reversed direction with regard to the axial direction, as compared to the first block 130. In accordance with the illustration the first block 130 is flowed through from right to left, whereas the second block is flowed through from left to right.

The separation element 104 on the one hand bounds the pressure chamber 102 in which the highest pressure acts and, on the other hand, bounds the two intermediate pressure chambers 107 and 108 in which an approximately half as large pressure acts as in the pressure chamber 102. This corresponds generally to the configuration illustrated in FIG. 2. For sealing the pressure chamber 102 with regard to the intermediate pressure chambers 107 and 108 a sealing element 5 is respectively provided which forms an embodiment of the sealing arrangement 1 in accordance with the invention having the adjacent bounding elements. In FIG. 6 the pump housing 103 forms the first bounding element 3 and the separation element forms the second bounding element 4. This sealing arrangement 1 is suitable for very high pressures. Thus, the pressure in the pressure chamber 102 can, for example, amount to 1000 bar. Then the pressure in the intermediate pressure chambers 107 and 108 is respectively approximately 500 bar.

It is understood that the sealing arrangement 1 in accordance with the invention can also be used at other positions of a high pressure pump. Having regard to the embodiment illustrated in FIG. 6, a sealing element 5 can, for example, also be disposed at the boundary between the pump cover 112 and the pump housing 103.

The invention claimed is:

1. A sealing arrangement for sealing a pressure chamber in a high pressure pump, the pressure chamber being bounded by a first bounding element and a second bounding element, comprising:

a separate sealing element having a first sealing surface configured to cooperate with the first bounding element and a second sealing surface configured to cooperate with the second bounding element, the first and second sealing surfaces being inclined with respect to one another and each of the first and second sealing surfaces having a groove configured to receive a sealing ring, and the separate sealing element being arranged and configured so as to cover a gap opening between the first bounding element and the second bounding element by being displaced along one of the first and second bounding elements on application of a predetermined pressure.

2. The sealing arrangement in accordance with claim 1, wherein the first and second sealing surfaces of the separate sealing element include an angle of 90°.

3. The sealing arrangement in accordance with claim 1, further comprising a support ring configured to position the separate sealing element in a starting position.

4. The sealing arrangement in accordance with claim 3, wherein the support ring contacts a support surface of the separate sealing element in the starting position, and the support surface is different from the first and second sealing surfaces of the separate sealing element.

5. The sealing arrangement in accordance with claim 1, wherein the separate sealing element has an L shaped cross-section having a long shank which forms the first sealing surface and having a short shank which forms the second sealing surface.

6. The sealing arrangement in accordance with claim 1, wherein the separate sealing element is arranged in a displaceable manner along the first bounding element and the second bounding element.

7. The sealing arrangement in accordance with claim 1, wherein the first sealing surface is conically formed between the groove disposed therein and an end thereof facing the second sealing surface.

8. The sealing arrangement in accordance with claim 7, wherein an angle of a cone formed by the first sealing surface amounts to at most 2°.

9. The sealing arrangement in accordance with claim 7, wherein an angle of a cone formed by the first sealing surface amounts to at most 1°.

10. The sealing arrangement in accordance with claim 1, wherein the second sealing surface is conically formed between the groove disposed therein and an end thereof facing the first sealing surface.

11. The sealing arrangement in accordance with claim 10, wherein an angle of a cone formed by the second sealing surface amounts to at most 2°.

12. The sealing arrangement in accordance with claim 10, wherein an angle of a cone formed by the second sealing surface amounts to at most 1°.

13. The sealing arrangement in accordance with claim 1, wherein the sealing arrangement is a radial seal arrangement.

14. A high pressure pump, comprising:

a pressure chamber;

a first bounding element; a a second bounding element, the first and second bounding elements bounding the pressure chamber; and a sealing arrangement comprising a separate sealing element having a first sealing surface configured to cooperate with the first bounding element and a second sealing surface configured to cooperate with the second bounding element, the first and second sealing surfaces being inclined with respect to one another and each of the first and second sealing surfaces having a groove configured to receive a sealing ring, and the separate sealing element being arranged and configured so as to cover a gap opening between the first bounding element and the second bounding element by being displaced along one of the first and second bounding elements on application of a predetermined pressure.

15. The high pressure pump in accordance with claim 14, further comprising a pump cover and a pump housing, the sealing arrangement being configured to seal between the pump cover and the pump housing.

16. The high pressure pump in accordance with claim 14, wherein the high pressure pump is a multi-stage pump.

17. The high pressure pump in accordance with claim 14, wherein the sealing arrangement is configured to seal between the pressure chamber and an intermediate pressure chamber.

18. The high pressure pump in accordance with claim 14, wherein the sealing arrangement is configured to seal between a separation element and the pump housing or between the pump cover and the pump housing.

* * * * *